US006094124A

United States Patent [19]

Lee

[11] Patent Number: 6,094,124

[45] Date of Patent: Jul. 25, 2000

[54] BALLAST FOR DISCHARGE LAMP AND METHOD AND APPARATUS FOR MANUFACTURING THE SAME

[76] Inventor: Kyung-Soo Lee, No.-401, Samjung Green Villa, Yatao-dong 1S1, Boondang-ku, Sungnam-si, Kyungki-do 463-070, Rep. of Korea

[21] Appl. No.: 09/029,805

[22] PCT Filed: Jul. 24, 1996

[86] PCT No.: PCT/KR96/00114

§ 371 Date: Jul. 27, 1998

§ 102(e) Date: Jul. 27, 1998

[87] PCT Pub. No.: WO97/10608

PCT Pub. Date: Mar. 20, 1997

[30] Foreign Application Priority Data

Sep. 12, 1995 [KR] Rep. of Korea ..... 95-29604

[51] Int. Cl.[7] ..... H01F 27/26; H01F 27/02

[52] U.S. Cl. ..... 336/210; 336/234; 336/90; 336/96; 29/609

[58] Field of Search ..... 336/234, 210, 336/90, 96; 29/606, 609

[56] References Cited

U.S. PATENT DOCUMENTS

| | | | |
|---|---|---|---|
| 3,665,358 | 5/1972 | Leuck et al. | 336/96 |
| 4,509,032 | 4/1985 | Post | 336/59 |
| 5,479,697 | 1/1996 | Togo | 29/606 |
| 5,524,334 | 6/1996 | Boesel | 29/605 |

FOREIGN PATENT DOCUMENTS 2100070A 12/1982 United Kingdom .

*Primary Examiner*—Lincoln Donovan
*Assistant Examiner*—Anh Mai
*Attorney, Agent, or Firm*—Anthony J. Casella; Gerald E. Hespos; Michael J. Porco

[57] ABSTRACT

Ballast for a discharge lamp, which can make a sustained power supply to the discharge lamp, and method and apparatus for manufacturing the same, are disclosed. The ballast having a core assembly (4) with one pair of stacks of a plurality of cores (3) symmetrically inserted into a bobbin (2) wound with copper wire (1), and the ballast including one retainer (9) for surrounding and fixing the entire core assembly (4).

7 Claims, 9 Drawing Sheets

BALLAST FOR DISCHARGE LAMP AND METHOD AND APPARATUS FOR MANUFACTURING THE SAME

BACKGROUND OF THE INVENTION

1. Field of the Invention

The present invention relates to a ballast for a discharge lamp, which can make a sustained power supply to the discharge lamp, and method and apparatus for manufacturing the same.

2. Description of the Prior Art

The ballasts may be classified at large into open type ballasts each of which core assembly is exposed to air and closed type ballasts each of which core assembly is sealed within a case by a stuffing material.

As their core assemblies are exposed to air, the open type ballasts are widely used in discharge lamps for domestic use or office use in which foreign materials, such as dusts do not affect, while the closed type ballasts are widely used in discharge lamps for outdoor signboards, moist or dusty shops, or places in which safety is required.

The ballast includes a core assembly having a bobbin wound with copper wire, into which bobbin two stacks of a plurality of cores each having an "E" form are inserted in opposite direction so that both ends of the opposite "Es" are come into contact while the central ends of the opposite "Es" leave a gap between them.

The most important performance of the ballast, that is a stable supply of power to a discharge lamp, is decided by the gap between the central ends of the cores of the core assembly.

FIG. 1 illustrates a perspective view of a conventional open type ballast, of which structure and manufacturing method will be explained, hereinafter.

A core assembly 4 includes a bobbin 2 wound with copper wire 1, into which bobbin 2 stacks of a plurality of cores 3 are inserted oppositely.

The core assembly 4 is, held by downward bent parts, fixed within a retainer 5.

To manufacture this ballast, the copper wire 1 is wound around the bobbin 2 for predetermined number of times as a preparation, and a plurality of the "E" formed cores 3 are stacked. Then, one pair of the stacked cores 3 are inserted into the prepared bobbin oppositely to form a gap G between the central ends 3*a* at a central part of the contact parts(R1).

This bobbin 2 with wound of the copper wire 1 and insertion of the cores 3 is called a core assembly.

When this core assembly is placed in a retainer 5 and both of upper edges of the retainer are pressed down by a press, both of the upper edges are bent inside to form the downward bent parts 5*a*, which hold upper surfaces of the cores 3 to fix the core assembly in the retainer 5(R2).

Then, the finished open type ballast is dipped and dried (R3).

FIG. 2 illustrates a perspective view of a disassembled conventional closed type ballast, and FIG. 3 illustrates a longitudinal sectional view of a assembled conventional closed type ballast shown in FIG. 2, in which it is shown that the open type ballast of the aforementioned structure is placed in a case 6 of which one side is opened and inside of which is stuffed with a stuffing material 7 and the opened part is closed by a cover 8.

A method for manufacturing the closed type ballast of the aforementioned structure will be explained.

First, the copper wire 1 is wound on an outer circumference of the bobbin 2 for predetermined number of times as a preparation, and a plurality of the "E" formed cores 3 are stacked. Then, one pair of the stacked cores 3 are inserted into the prepared bobbin 2 with both of the central ends 3*a* of the stacks to face inside of the bobbin 2 to form a core assembly 4(R1).

When this core assembly 4 is placed in a retainer 5 having upward bent pieces and upper edges of the upward bent pieces of the retainer 5 are pressed down by a press, both of the upper edges are bent inside to form the downward bent parts 5*a*, which hold upper surfaces of the cores 3 to fix the core assembly 4 in the retainer 5(R2).

After the core assembly 4 is fixed to the retainer 5 through aforementioned process, this is dipped(R3), placed into a case 6(R4) of which upper side is opened, sealed with the stuffing material 7(R5), and closed with a plate cover 8, thus, to finish the manufacturing of the ballast(R6).

However, the conventional open and closed type ballasts have the following problems.

First, the downward pressing on the upward bent pieces in the retainer 5 to press down upper surfaces of the cores 3, especially when the pressing down force is not constant, may cause the dimension of the gap G, which is the most important factor for a ballast performance, incorrect, resulting in assurance of the quality reproducibility being impossible.

That is, if the pressing force is weak, the contact between both ends can not be assured, and, contrary to this, if the pressing force is great, since the cores 3 that come into contact can not be maintained vertical to the other, but inclined to either one side, that reduces the gap G, the electrical performances of the ballast(characteristic values, inductance, and etc.) can be degraded.

Second, the exposure of the upper side of the cores 3 to air causes much noise during its operation.

Third, in order to seal the core assembly with the stuffing material 7, since the core assembly should be fixed by means of the downward bent parts 5*a* on the retainer 5, placed into an additional case 6, sealed by the stuffing material 7 and enclosed by the cover 8, the required many number of components and manufacturing process causes, not only the productivity low, but also the cost high.

Fourth, since the electrical performance test of the open type ballast should be carried out before the sealing by the stuffing material of the open type ballast placed in the case 6, to select good quality ones, the working efficiency has been low.

SUMMARY OF THE INVENTION

Accordingly, the present invention is directed to a ballast for a discharge lamp and method and apparatus for manufacturing the ballast that substantially obviates one or more of the problems due to limitations and disadvantages of the related art.

An object of the present invention is to provide a ballast having a stable electrical performance by inserting a core assembly into a retainer to be surrounded by the retainer, passing the retainer with the core assembly therein through a die, and welding a seam on the retainer.

Another object of the present invention is to provide a method for manufacturing a ballast, in which the core. assembly, fixed in a retainer, can be sealed by the stuffing material even without using the case.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the ballast for a discharge lamp, having a core assembly with one pair of stacks of a plurality of cores symmetrically inserted into a bobbin wound with copper wire, includes one retainer for surrounding and fixing the entire core assembly.

In another aspect, the present invention provides the method for manufacturing a ballast for a discharge lamp, including the steps of assembling a core assembly by winding copper wire around an outer circumference of a hollow bobbin for a predetermined number of times as a preparation, stacking a plurality of cores each having a form of an "E", and inserting one pair of the stacked cores into the hollow of the bobbin to face the central ends of both of the stacked cores inside of the hollow; forming a hexahedral retainer of a sheet of plate having a square hollow greater than the core assembly and inward projections, inserting the prepared core assembly into the retainer through an opening at one side of the retainer, passing the retainer having the core assembly therein through a die having a gradually narrowed passage with a wide entrance for pressing and banding the retainer as well as a firm fixation of the core assembly, and welding a seam line of the retainer when the retainer is passed through the die and discharging a final product.

In further aspect, the present invention provides an apparatus for manufacturing a ballast for a discharge lamp, including a feeding part for feeding retainers having a core assembly assembled therein to a transfer part in succession, the transfer part for transferring the retainers fed by the feeding part horizontally along an upper surface of a main body, a driving part for supplying power to the feeding part to operate the feeding part, a forming and welding part for close surrounding and fixing the core assembly by the retainer and welding a seam line on the retainer as the feeding part feeds the retainers, and a controlling part for sensing one of the retainers fed to the transfer part by the feeding part, activating the driving part for the transfer part to transfer the one retainer toward the forming and welding part, and restoring the transfer part back to an initial stage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
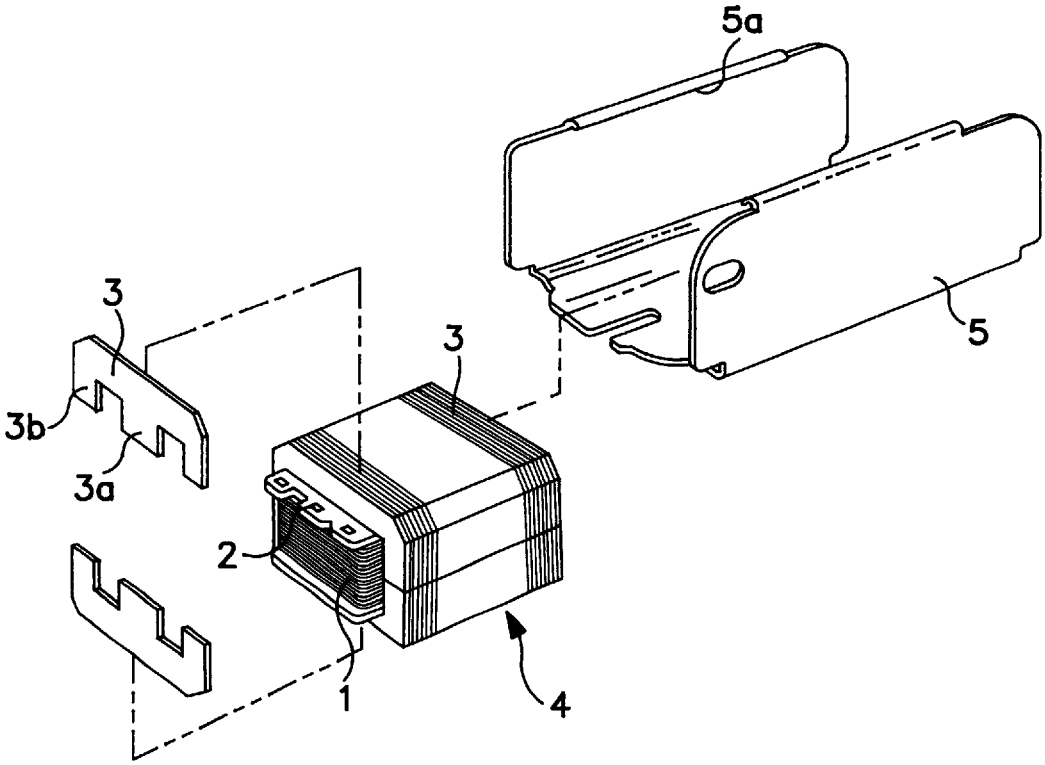
FIG. 1 illustrates a perspective view of a disassembled conventional open type ballast.
Figure 2:
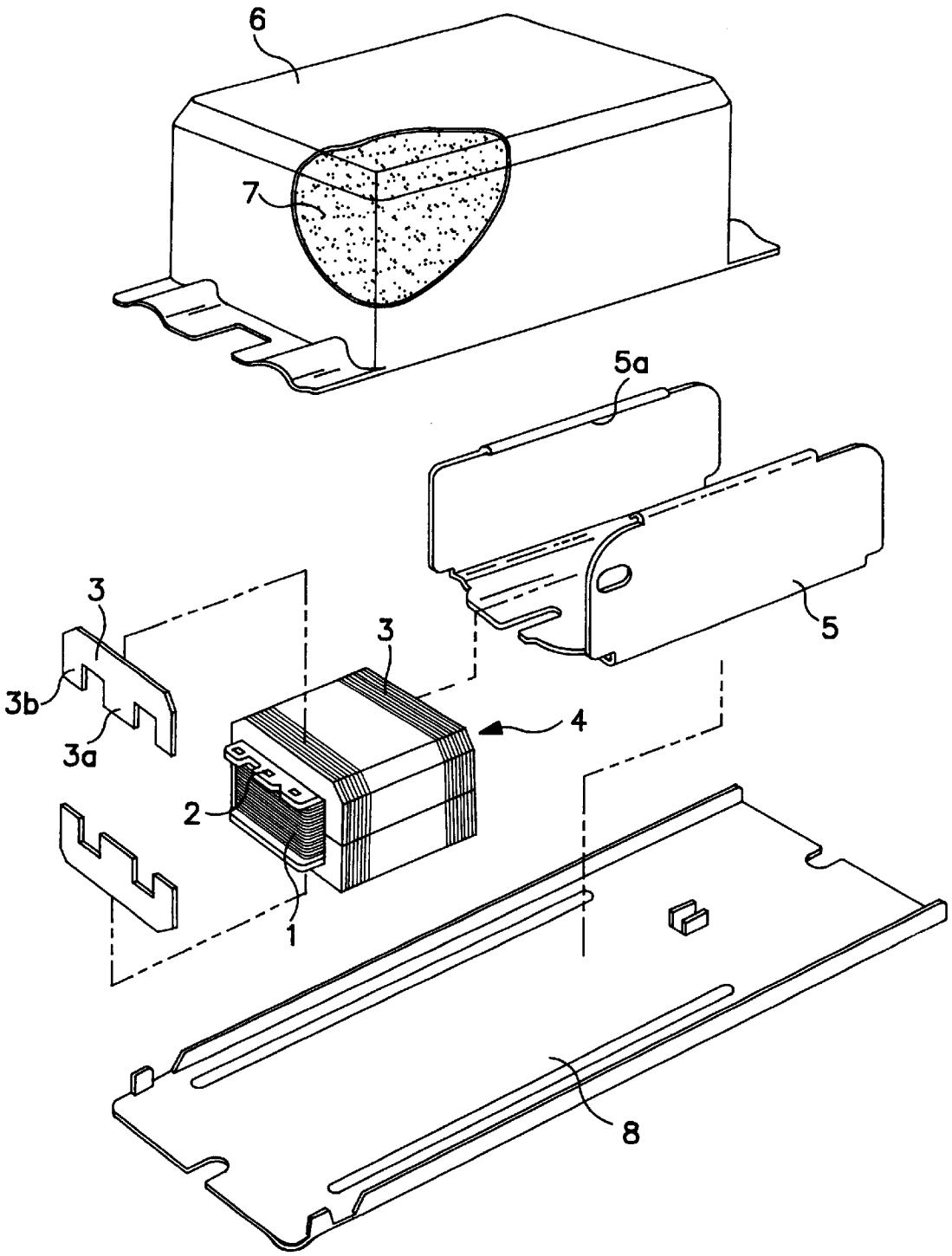
FIG. 2 illustrates a perspective view of a disassembled conventional closed type ballast.
Figure 3:
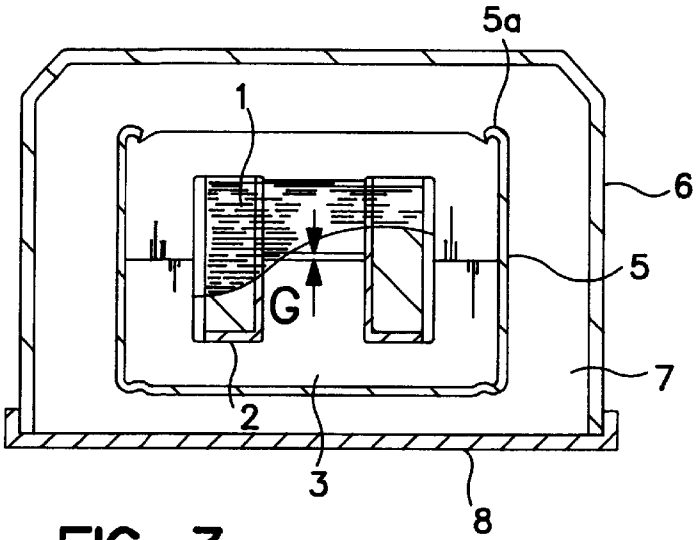
FIG. 3 illustrates a section along a longitudinal line of the closed type ballast in FIG. 2 for showing a state of assembly.
Figure 4:
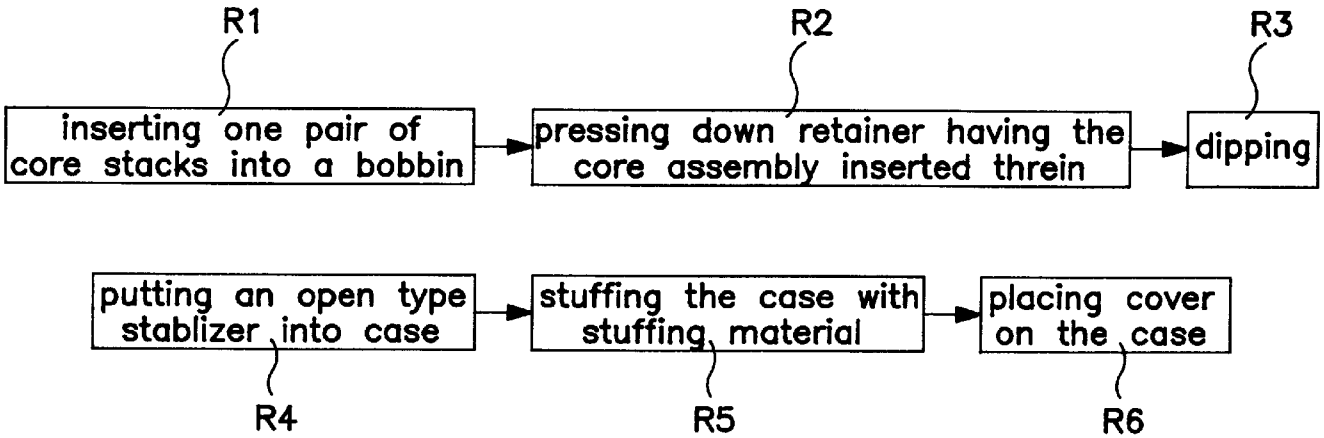
FIG. 4 shows the steps of a conventional method for manufacturing a ballast.
Figure 5:
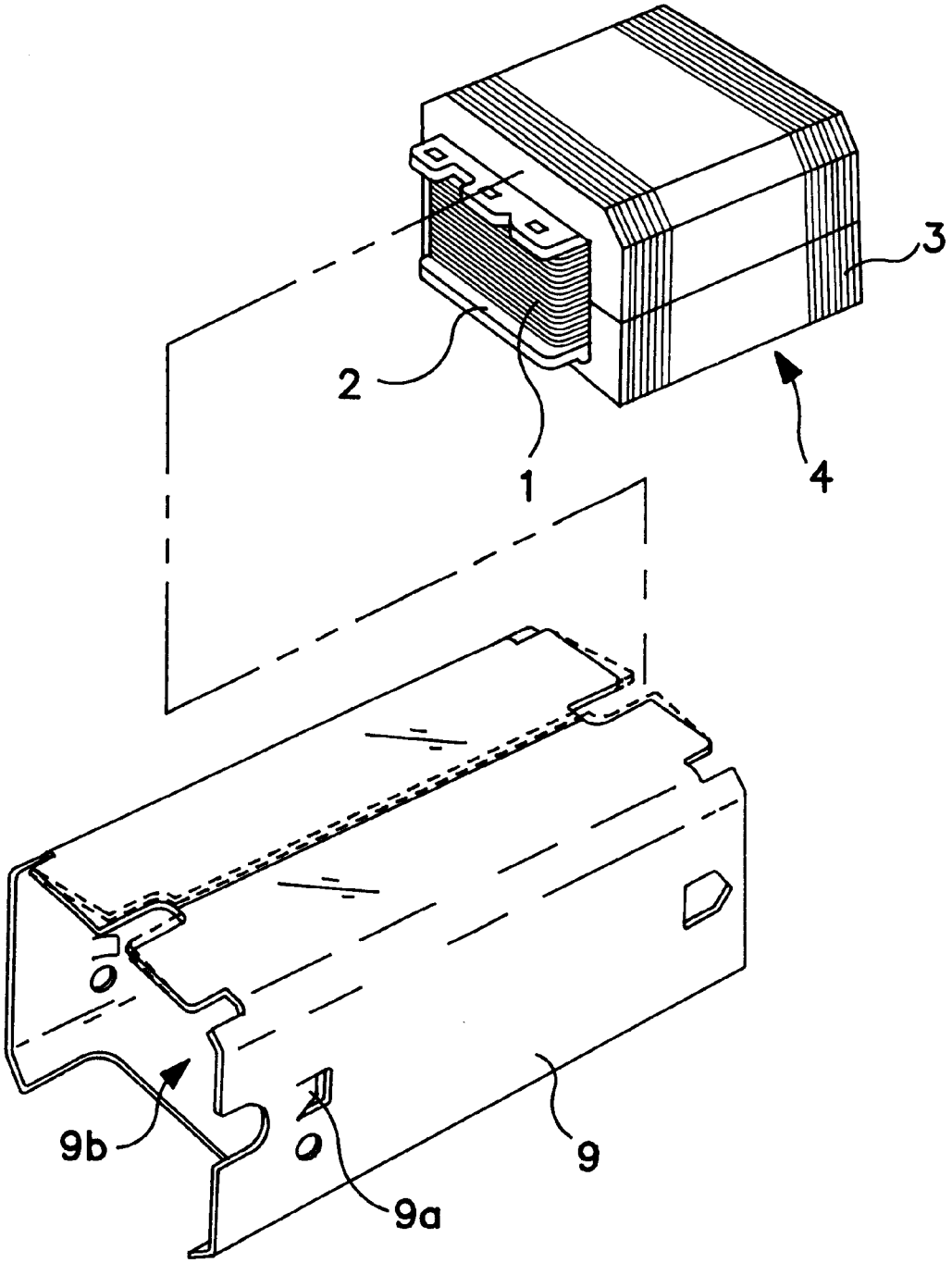
FIG. 5 illustrates a perspective view of a disassembled ballast in accordance with one embodiment of the present invention.
Figure 6:
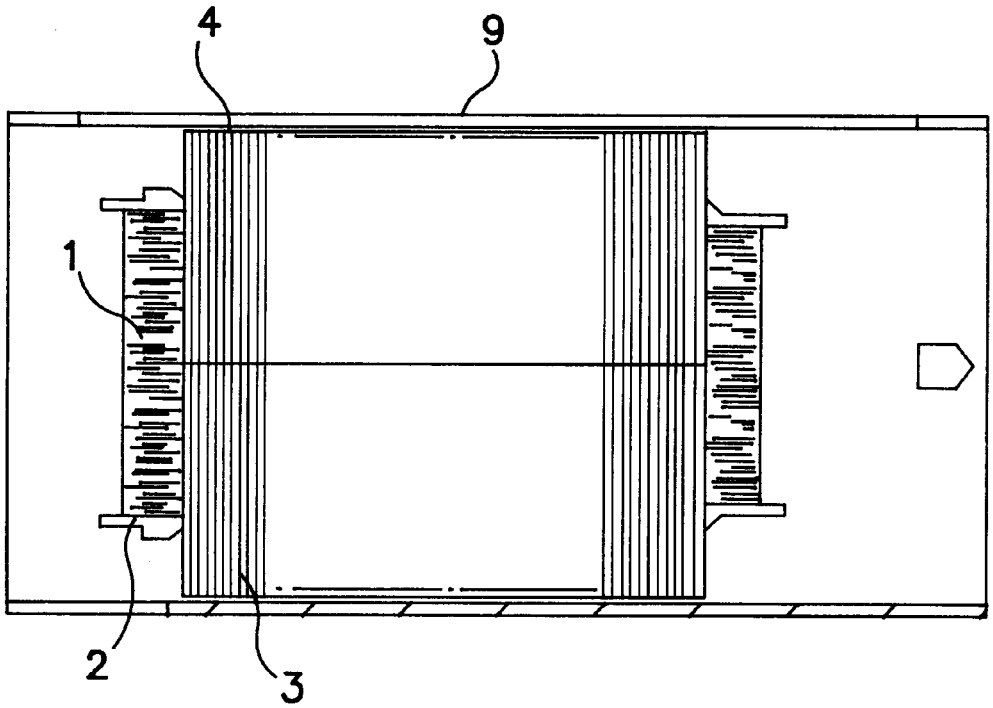
FIG. 6 illustrates a section along a longitudinal line of the ballast in FIG. 5 for showing a state of assembly.

FIG. 5 illustrates a perspective view of a disassembled ballast in accordance with one embodiment of the present invention; FIG. 6 illustrates a section along a longitudinal line of the ballast in FIG. 5 for showing a state of assembly; and FIG. 7 illustrates a section along a longitudinal line of a ballast in accordance with other embodiment of the present invention for showing a state of assembly.

Referring to FIG. 5 and 6, of the ballasts in accordance with the present invention, the open type ballast includes a core assembly 4 firmly surrounded by and fixed in a retainer 9, which core assembly having a bobbin 2 wound with copper wire 1 and one pair of stacks of cores 3 symmetrically inserted therein.

In order to limit extent of the insertion of the core assembly on insertion of the core assembly 4 into the retainer 9, inward projections 9*a* are formed at opposite positions.

Figure 7:
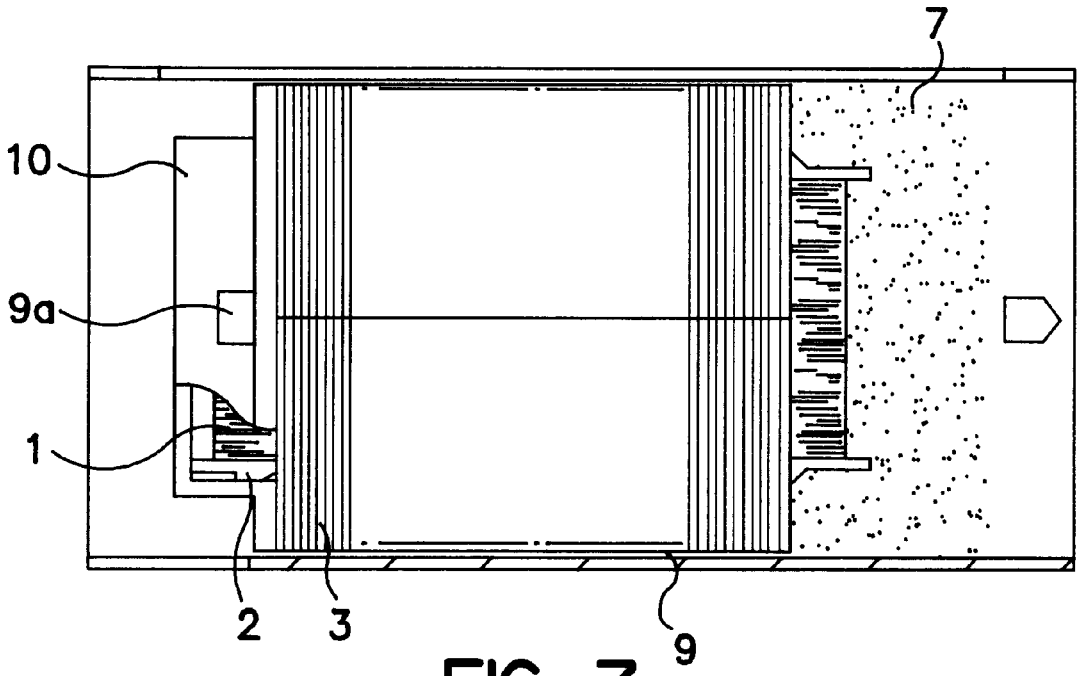
FIG. 7 illustrates a section along a longitudinal line of a ballast in accordance with other embodiment of the present invention for showing a state of assembly.

Referring to FIG. 7 illustrating a longitudinal section of the closed type ballast in accordance with the present invention, in which it is shown that one side of the core assembly 4 is covered with a cover 10 held by the inward projections 9*a* formed on the retainer 9 and the other side stuffed with the stuffing material 7, which seals the core assembly 4 inside of the retainer.

Figure 8:
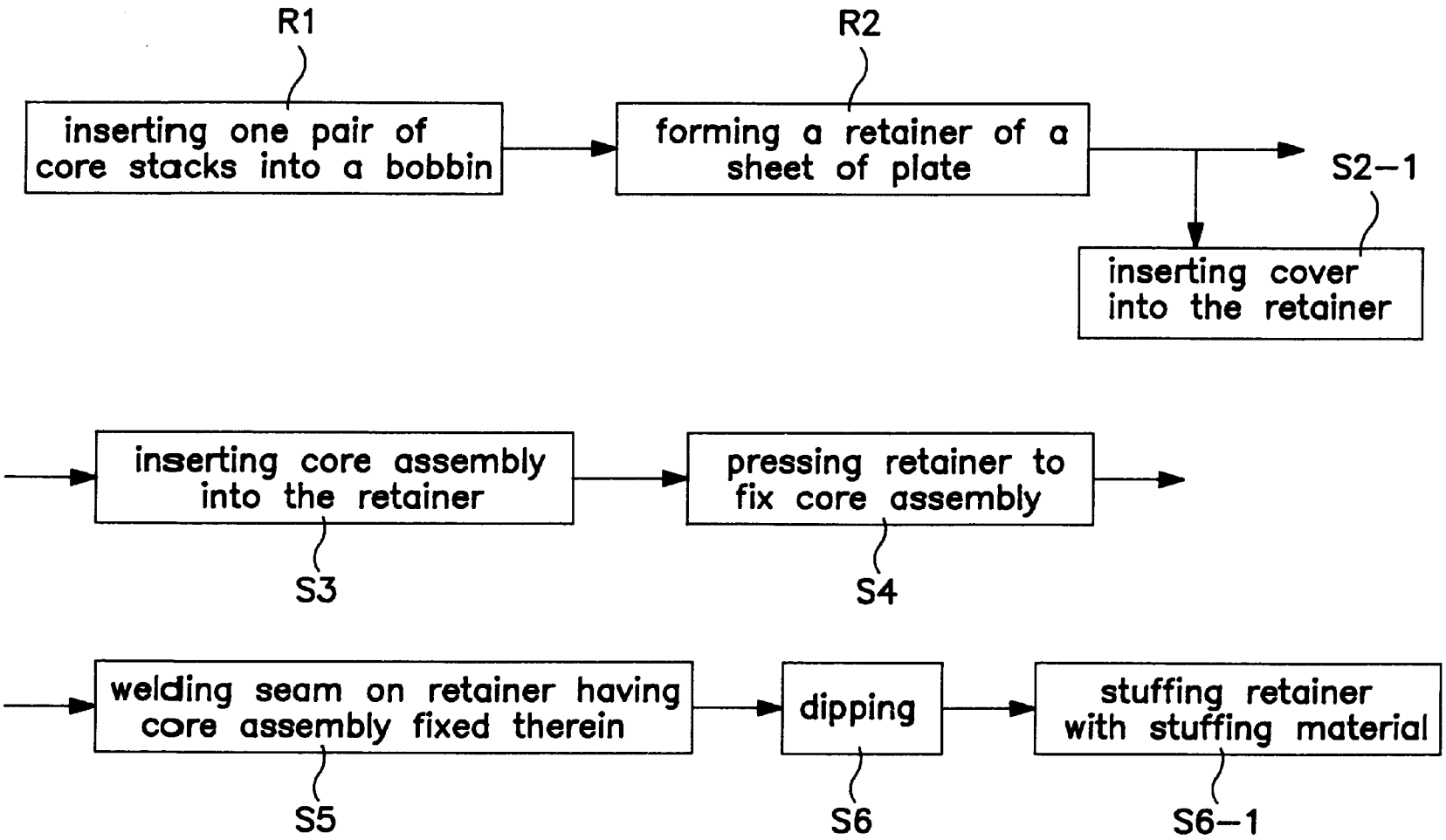
FIG. 8 shows the steps of a method for manufacturing a ballast in accordance with the present invention.

Of the methods for manufacturing the ballasts explained above, the method for manufacturing the open type ballast will be explained with reference to FIG. 8.

A hollow bobbin 2 wound with copper wire 1 around the outer circumference of the bobbin 2 is provided, and a plurality of cores 3 each having an "E" form are stacked, one pair of the stacked cores are inserted into the hollow of the provided bobbin 2 to face both of the central ends 3*a* of the stacked cores inside of the bobbin 2, to provide a core assembly 4(S1).

A sheet of plate is pressed to form a "⌂" form retainer 9 with its inner space 9*b* greater than the size of the core assembly 4 and at least one inward projection 9*a* on one side of the retainer(S2).

Upon having the core assembly 4 and the retainer 9 provided, the provided core assembly 4 is inserted into the retainer 9 through one opening thereof(S3).

After assembly of the core assembly 4 in the retainer 9, the retainer 9 having the core assembly 9 assembled therein is passed through a die 11 having a gradually narrowed passage with a wide inlet (inserting side for the retainer) to press and banding the retainer 9, resulting the retainer 9 surrounded and firmly fixed by the retainer 9(S4).

When the retainer 9 banded the core assembly 4, surrounding and fixing the core assembly 4 while passing through the S4 step, is discharged, a separate welder 12 carries out welding at a seam line on the retainer 9(S5).

Then, the retainer 9 with the core assembly 4 therein is subjected to a dipping process (S6), to obtain the open type ballast as shown in FIGS. 5 and 6.

The closed type ballast is manufactured as follows.

Alike the method for manufacturing the open type ballast, a core assembly 4 is assembled and a retainer 9 is formed of a sheet of plate. Then, before assembly of the core assembly 4 in the retainer 9, a cover 10 is inserted into the retainer to close one side of the retainer(S2-1).

In this time, the cover 10 inserted into the retainer 9 is caught and held by the inward projection 9*a*.

Under this condition, when the core assembly 4 is assembled in the retainer 9 and passed through the aforementioned S3 to S5 steps, the core assembly 4 and the cover 10 are firmly fixed in the retainer 9, to close one side of the retainer.

Thereafter, the retainer 9 with the core assembly 4 and the cover 10 fixed therein is dipped S6. And, a stuffing material 7 is injected into the retainer 9 through the other opening thereof to seal the core assembly 4(S5-1).

Figure 9:
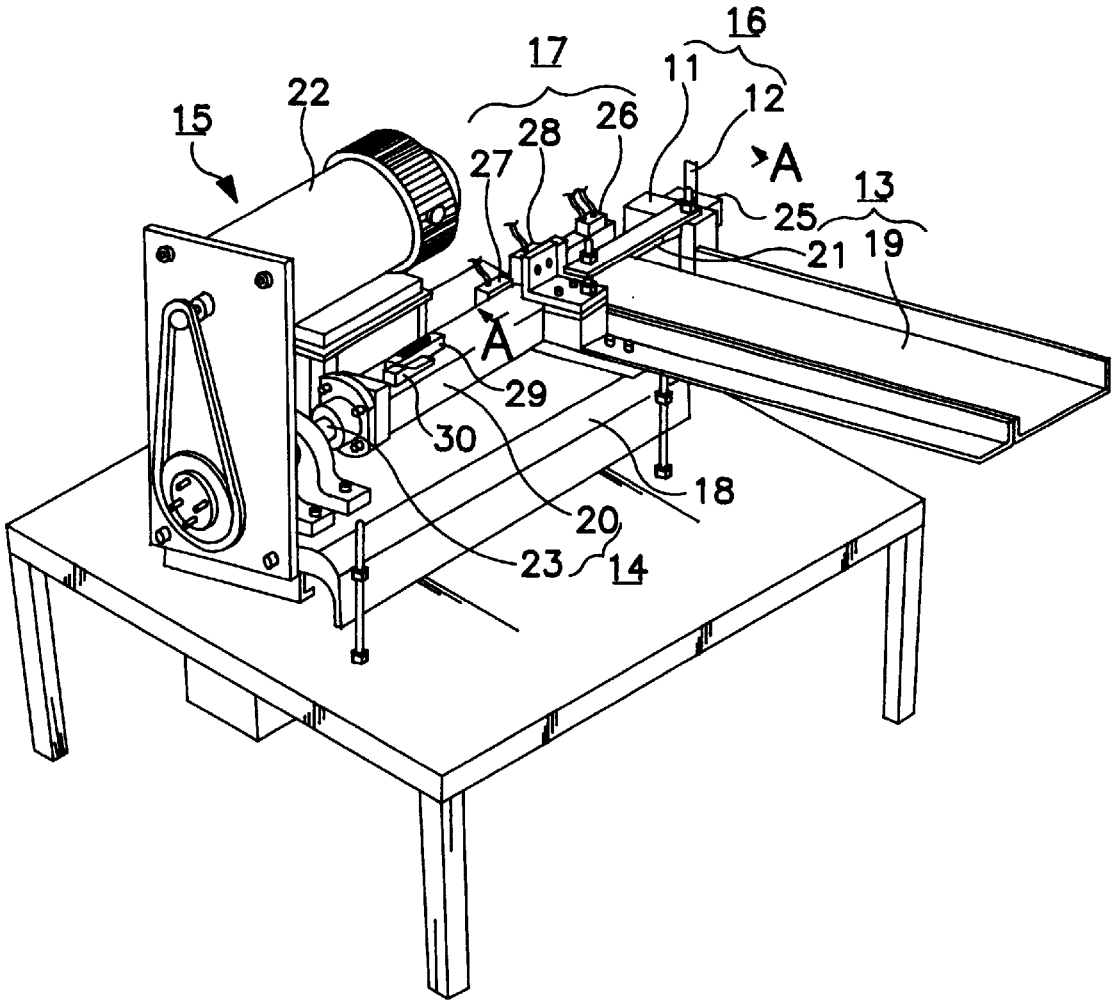
FIG. 9 illustrates a perspective view of an apparatus in accordance with the present invention for manufacturing a ballast of a discharge lamp.
Figure 10:
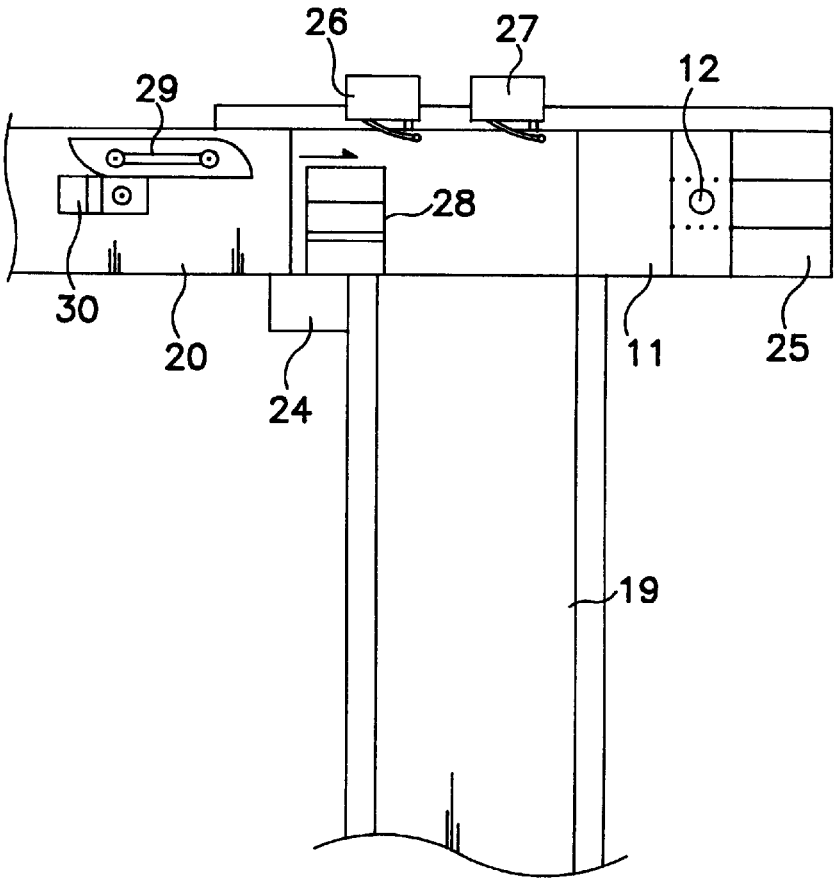
FIG. 10 illustrates a partial plane view of the apparatus for manufacturing a ballast in accordance with the present invention.
Figure 13:
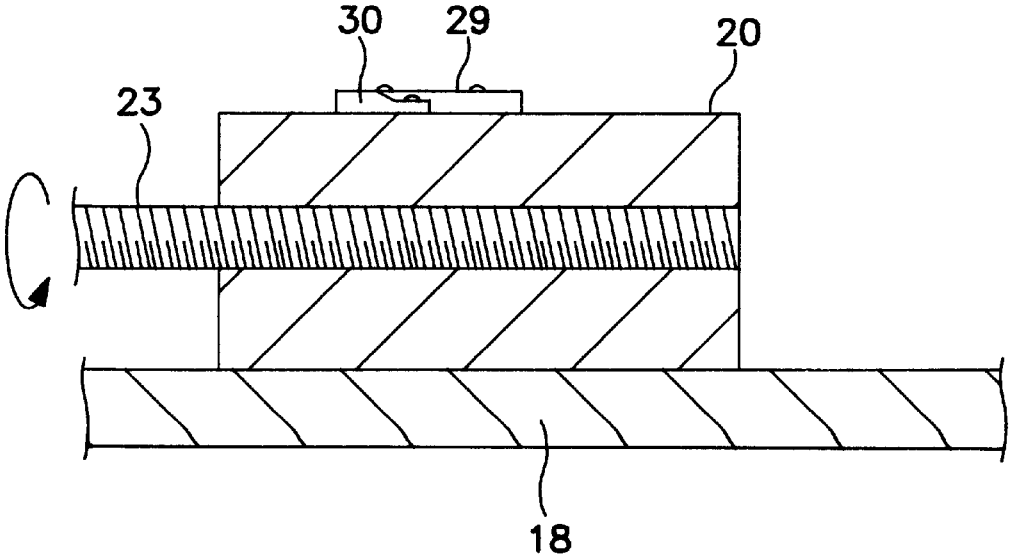

FIG. 9 illustrates a perspective view of an apparatus in accordance with the present invention for manufacturing a ballast of a discharge lamp; FIG. 10 illustrates a partial plane view of the apparatus for manufacturing a ballast in accordance with the present invention; and FIG. 13 illustrates a section along a longitudinal line of a coupling of a lead screw and a slider.

The apparatus in accordance with the present invention includes a feeding part 13 for feeding the retainer 9 having the core assembly 4 assembled therein, a transfer part 14 for transferring the retainer horizontally, a driving part 15 for supplying power to the feeding part, a forming and welding part 16 for pressing and banding the retainer 9 and welding a seam on the retainer, and a controlling part 17 for controlling operation of the transfer part.

The feeding part 13 includes a retainer feeding rail 19 inclined downwardly at one side of the main body 18 for gravity feeding of the retainers 9 toward the transfer part with the core assemblies 4 in succession as the retainers are placed on the feeding rail 19.

A magnet 21 provided on a lower part of the feeding rail 19 for being activated and holding a retainer only when a slider 20 in the transfer part 14 is activated to push the retainer 9 toward the forming and welding part 16 and retreat, and being deactivated and releasing the retainer when the slider 20 is at standby or moving forward. This is for preventing the retainer 9, at standby when the slider 20 retreats, from being fed toward the transfer part side with the retainer being inclined to one side.

Referring to FIG. 13, the transfer part 14 includes a lead screw 23 reversibly rotated by a motor 22 in the driving part 15 and idly rotatable, and the slider 20 thread coupled with the lead screw 23, advancing and retreating guided by a guide rail 24 fixed along side the main body 18, for pushing the retainer 9 toward the forming and welding part 16 depending on the direction of rotation of the lead screw.

Though the transfer part 14 is embodied to includes the lead screw 23 and the slider 20 in the one embodiment of the present invention, but the embodiment of the present invention is, not limited to this, but may includes any structure as far as the structure can push the retainer 9 toward the welding and forming part side 16. Because, the retainer 9 may be pushed toward the forming and welding part 16 by means of a piston-cylinder or a rodless cylinder.

A structure of the forming and welding part 16 is as follows.

Figure 11:
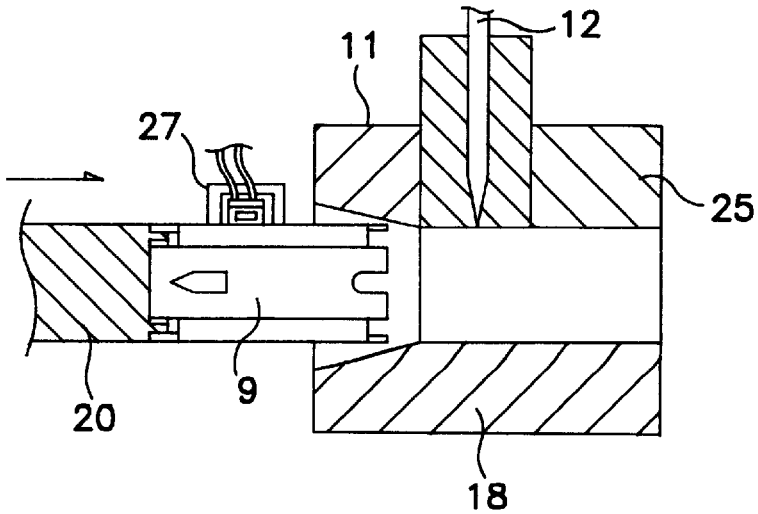
FIG. 11 illustrates a cross section along the A—A line shown in FIG. 9.

Referring to FIG. 11, a die 11 is fixed to the main body 18 mounted on a straight line to the slider 20. The die 11 has a passage therein having an inlet wider than the size of the retainer 9, which is gradually reduced so as to press and finally band the core assembly 4 in the retainer 9.

A welding machine 12 is provided on the outlet side of the die 11 for welding a seam on the retainer 9 which firmly surrounds the core assembly 4 as it passed through the die 11 for prevention of the retainer from being distorted, and a supplementary die 25 is provided on one side of the die for guiding the discharged retainer 9.

The controlling part 17 includes a first sensor 26 provided on a straight line to the retainer feeding rail 19 (the direction of feeding the retainers) for sensing the retainer 9 as the retainer 9 fed by its gravity and applying power to the motor 22, and turning off the motor as the slider 20 returns back to its initial stage, a second sensor 27 provided in front of the die 11 for informing a welding time to the welding machine 12 when the slider 20 forwards the retainer 9 into the passage in the die 11 to press and band the retainer 9 and reducing a transfer speed of the slider 20 to a speed suitable for the welding, and a third sensor 28 fixed to the main body 18 for reversing the motor 22 on sensing full advance of the slider 20.

Figure 12:
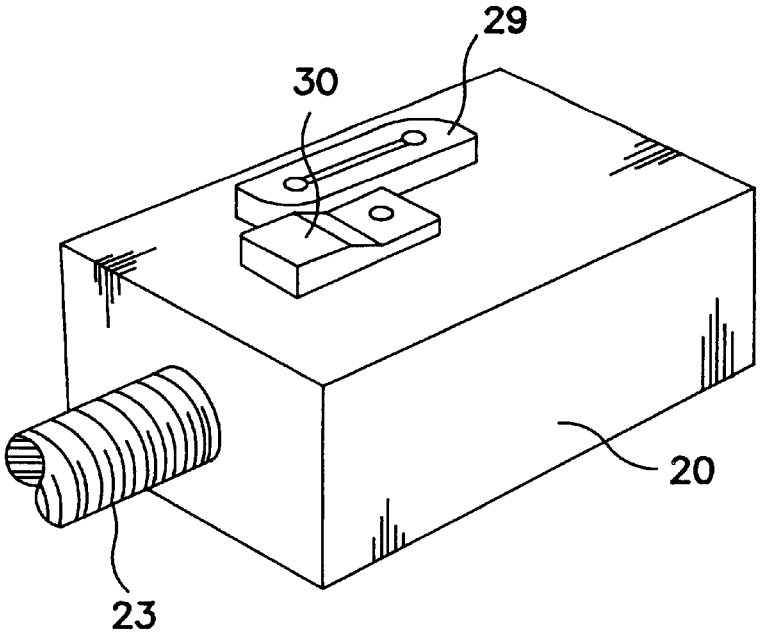
FIG. 12 illustrates a perspective view of a cam mechanism of the first and second cams in a transfer part; and, FIG. 13 illustrates a section along a longitudinal line of a coupling of a lead screw and a slider.

By having the first, second and third switches 26, 27 and 28 each formed of a limit switch and, as shown in FIG. 12, fixing a first and second cams 29 and 30 on the upper surface of the slider 20 for controlling the operation of the controlling part 17, the first and second cams 29 and 30 can control operation of the motor 22 by activating the limit switches in succession as the slider advances and retreats.

The operation and advantages of the apparatus in accordance with the present invention will be explained.

First, upon placing the retainers 9 with the core assemblies 4 therein on the feeding rail 19, the retainers, as the retainer feeding rail 19 is inclined downwardly, moved down toward the guide rail 24 by its gravity in succession until one of the retainer 9 comes in contact with the first sensor 26 to turn on a contact point thereof.

Accordingly, since the first sensor 26 in the controlling part 17 induce to supply power to the motor 22 in the driving part 15, to rotate the lead screw 23 in the transfer part 14 in a counter clockwise direction when the drawing is seen from above, the slider 20, thread coupled with the lead screw 20 as shown in FIG. 13, is advanced toward the die 11, to forward the retainer 9 transferred along the guide rail 24.

When the slider 20 forwards the retainer 9 toward the die 11 side, the retainer in a ⌂ form, while passing through the die 11 having a passage with an inlet wider than greater than the size of the retainer and gradually narrowed as it goes backward, is pressed and banded to finally surround the core assembly 4 in the retainer firmly.

In this time, since the first cam 29 fixed on the slider 20 presses the contact point of the second sensor 27 to inform the time for operation of the welding machine 12 and reduce number of revolutions of the motor 22, advancing the slider 20 slowly for welding of the seam on the retainer 9 by the welding machine 12, the retainer having its seam welded is discharged and then the operation of the motor 22 is stopped.

As the retainer with the core assembly 4 firmly fixed therein and having the seam welded thus is discharged, i.e., the slider 20 is advanced to the maximum extent, the second cam 30 fixed on the upper surface of the slider 20 turns on the contact point of the third sensor 28 fixed on one side of the guide rail 24, to rotate the stopped motor 22 in a reverse direction and apply power to the magnet 21 below the retainer feeding rail 19.

According to this, the lead screw 23 rotates in a clockwise direction when the drawing is seen from above, to restore the slider 20 back to an initial stage and hold one of the retainers 9 located at the lowest position of the retainer feeding rail 19 by the magnetic force from the magnet 21.

Upon restoration of the slider 20 according to the aforementioned operation, since the contact point of the first sensor 26 having been pressed as the slider moved is turned off, to cut the power supply to the motor 22 off as well as the power to the magnet 21, the retainer 9, having been held by the electric magnet is dropped down by its gravity onto the upper surface of the guide rail 24.

When the retainer 9 located at the lowest position of the retainer feeding rail 19 is fed to the upper surface of the guide rail 24, since the turned off contact point of the first sensor 26 comes into contact again by the impact of the drop, power is supplied to the motor 22 in the driving part 15.

According to this, as the retainer 9 with the core assembly 4 therein is pushed toward the die 11 side by an identical operation explained above, an automatic and continuous manufacture of ballasts is made possible.

As has been explained, the present invention has the following various advantages.

First, as the circumference of the core assembly 4 is surrounded and fixed in one retainer 9 by a constant pressing force of the die, resulting to have the gap between the central ends of the cores 3 always constant, the quality reproducibility can be maintained and the life of the discharge lamp can be extended.

That is, unlike the conventional ballast in which the upward bent pieces on the retainer is pressed by a press, as the retainer of a "⌂" form having the core assembly 4 inserted therein is passed through the die 11, pressing and fixing the core assembly, the pressure exerted on the core assembly can be always maintained constant.

Second, as the core 3, enclosed by the retainer 9, is not exposed to air, no noise is generated during operation of the ballast.

Third, as the retainer 9, which fixes the cote assembly 4, acts as the case when the stuffing material 7 is stuffed, different from the conventional closed type ballast, no separate case 6 and cover 8 are required. According to this, the number of component is reduced, resulting in reduction of production cost.

Fourth, since the fixing process of the core assembly 4 in the retainer 9 may be carried out in an automated process line in succession, there is an improvement in the productivity.

Fifth, as the uniform gap dimension coming from the insertion of the core assembly into the retainer, the surrounding and fixing of the core assembly 4 by the retainer 9, and the passing of the retainer with the core assembly therein through the die eliminates the necessity for the electrical performance test before sealing the core assembly 4 with the stuffing material 7, that shorten the steps of process, which help improve productivity.

It will be apparent to those skilled in the art that various modifications and variations can be made in method for fabricating semiconductor device of the present invention without departing from the spirit or scope of the invention. Thus, it is intended that the present invention cover the modifications and variations of this invention provided they come within the scope of the appended claims and their equivalents.

What is claimed is:

1. A ballast for a discharge lamp, comprising:

a core assembly with one pair of stacks of a plurality of cores symmetrically inserted into a bobbin wound with copper wire, the core assembly having a plurality of outer surfaces intersecting one another at convex corners such that said outer surfaces are substantially free of recesses, said outer surfaces comprising a bottom surface defining a width; and a retainer for accommodating the entire core assembly, the retainer being formed from a single sheet of plate material and including a bottom plate having a pair of opposed sides defining a width for the bottom plate that is substantially equal to the width of the bottom surface of the core assembly, a pair of side walls upwardly bent respectively from the respective sides of the bottom plate, each side wall having a top end at a location thereon remote from the bottom plate and a pair of coplanar top plates inwardly bent respectively from the top ends of the respective side walls, the top plates defining a combined width substantially equal to the width of the bottom plate, edges of the top plates remote from the side walls being welded into edge to edge relationship such that the retainer tightly surrounds and fixes the core assembly without overlapping the top plates.

2. A ballast as claimed in claim 1, wherein inward projections are formed on opposite sides of the retainer for limiting extent of the insertion of the core assembly.

3. A ballast for a discharge lamp, the ballast comprising:

a core assembly with one pair of stacks of a plurality of cores symmetrically inserted into a bobbin wound with copper wire;

one retainer passing through a die having a gradually narrowed passage with a wide entrance for closely surrounding and fixing the entire core assembly, inward projections being formed on opposite sides of the retainer for limiting insertion of the core assembly into the retainer; and a cover caught by the inward projections for closing one side of the retainer and a stuffing material stuffed through an opening in the other side of the retainer surrounding the core assembly for sealing the core assembly.

4. A method for manufacturing a ballast for a discharge lamp, the method comprising the steps of:

assembling a core assembly by winding copper wire around an outer circumference of a hollow bobbin for a predetermined number of times as a preparation, stacking a plurality of cores each having an "E" form, and inserting one pair of the stacked cores into the hollow of the bobbin to face the central ends of both of the stacked cores inside of the hollow;

forming a retainer of a sheet of plate, the retainer having a hollow greater than the core assembly and inward projections;

inserting the prepared core assembly into the retainer through an opening at one side of the retainer;

passing the retainer having the core assembly therein through a die having a gradually narrowed passage with a wide entrance for pressing and banding the retainer as well as a firm fixation of the core assembly; and welding a seam line on the retainer when the retainer is passed through the die and discharging a final product.

5. A method as claimed in claim 4, further comprising a step for inserting a cover into the retainer for being caught and held by the inward projections for closing an opening at one side of the retainer before the step of inserting the prepared core assembly into the retainer, and a step for sealing the core assembly in the retainer by injecting a stuffing material into an opening at the other side of the retainer after the step of welding a seam line on the retainer.

6. A ballast for a discharge lamp made in accordance with the method of claim 5.

7. A ballast for a discharge lamp made in accordance with the method of claim 4.

* * * * *